US007731806B2

(12) United States Patent
Hapke

(10) Patent No.: US 7,731,806 B2
(45) Date of Patent: Jun. 8, 2010

(54) AUTOMATIC DOOR FOR DISHWASHER

(75) Inventor: Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 962 days.

(21) Appl. No.: 10/784,525

(22) Filed: Feb. 23, 2004

(65) Prior Publication Data

US 2004/0163684 A1 Aug. 26, 2004

Related U.S. Application Data

(60) Provisional application No. 60/450,257, filed on Feb. 25, 2003.

(51) Int. Cl.
*B08B 3/00* (2006.01)

(52) U.S. Cl. ..... 134/57 DL; 134/58 DL

(58) Field of Classification Search ..... 134/57 DL, 134/58 DL

See application file for complete search history.

(56) References Cited

U.S. PATENT DOCUMENTS 2,891,560 A 6/1959 Ullman, Jr. et al.
3,985,023 A 10/1976 Guth
4,510,777 A * 4/1985 Ellingson et al. ..... 68/12.26
4,951,693 A * 8/1990 Archambault ..... 134/57 DL
5,881,746 A * 3/1999 Buser et al. ..... 134/58 D
6,295,004 B1 * 9/2001 Burnett ..... 340/686.1
6,811,236 B1 * 11/2004 Spong et al. ..... 312/405

FOREIGN PATENT DOCUMENTS

EP 0687439 * 3/1995
EP 1433893 A2 6/2004
JP 6328940 * 5/1993

* cited by examiner

*Primary Examiner*—Michael Barr
*Assistant Examiner*—Jason P Riggleman
(74) *Attorney, Agent, or Firm*—Boyle Fredrickson, S.C.

(57) ABSTRACT

Automatic sealing of a dishwasher door is obtained through an electric actuator that moves the door from a close position adjacent to the opening of the washing chamber to a seal position in which the washing chamber is sealed typically against a gasket or the like. The actuator eliminates the need for the user to provide the force necessary to seal the gasket and/or can be used for improved venting of the washing chamber.

11 Claims, 7 Drawing Sheets

AUTOMATIC DOOR FOR DISHWASHER

CROSS-REFERENCE TO RELATED APPLICATIONS

This application claims the benefit of U.S. Provisional Application 60/450,257 filed Feb. 25, 2003 which is hereby incorporated by reference.

STATEMENT REGARDING FEDERALLY SPONSORED RESEARCH OR DEVELOPMENT

BACKGROUND OF THE INVENTION

The present invention relates to dishwashers for cleaning dishes and cutlery and more specifically to an automatic door for such dishwashers.

A residential dishwasher may provide a washing chamber into which soiled dishes are placed and held by racks or the like. At the time of washing, the door to the chamber is closed and the dishes are sprayed with hot, soapy water. The door may include a gasket sealing the door against the chamber to prevent water leakage during the spraying process.

Properly compressing the door gasket may require considerable force. This force may be applied by a vigorous pressing against the door by the user or by a lever-action latch offering sufficient mechanical advantage to compress the gasket with motion of a lever or the like. Such latches can be cumbersome to operate and require adjustment over time as they wear and the compliance of the gasket changes.

Just as it is desirable to seal the washing chamber during the washing process, it is desirable to vent the washing chamber when the dishes are drying. This venting may be accomplished through baffled ducts incorporated into the door passing moist air but preventing the passage of liquid water. Alternatively, electrically actuated shutters on door vents may open during the drying process. These latter electrically operated vents have the advantage that they may be closed during the washing cycle to reduce the transmission of noise into the kitchen. Vents suitable for this purpose are taught in co-pending U.S. Pat. No. 6,293,289 issued Sep. 25, 2001 and assigned to the assignee of the present invention and hereby incorporated by reference.

BRIEF SUMMARY OF THE INVENTION

The present invention provides an automatic dishwasher door closed by an electrical actuator. The user may move the door to a close position covering the washing chamber and the door is automatically pulled into a seal position by the actuator eliminating the need for complex bolt mechanisms or the application of substantial force by the user in closing the door.

Optionally this same mechanism may be used to open the dishwasher door automatically to a venting position in which the door visibly covers the washing chamber but which still provides a substantial gap around the edges of the door through which water vapor may pass. The total area of a small gap around the door may exceed by many times the area of standard door vents to substantially improve drying.

Specifically then, the present invention provides a dishwasher having a washing chamber with a door movable from an open position permitting the loading of the washing chamber, through a close position covering the washing chamber, to a seal position sealing water within the washing chamber. An electric actuator responding to an electric signal moves the door between the close position and the seal position.

It is an object of at least one embodiment of the invention to provide a dishwasher that may automatically seal its own door without the application of force by the user. By separating the force needed to close the door and the force needed to seal the door, the door may be made easier to manipulate by the consumer and greater engineering flexibility may be had in the selection and design of gaskets.

The close position may provide a space between the washing chamber and the door allowing venting of the washing chamber.

Thus, an object of another embodiment of the invention is to provide improved venting of the washing chamber to aid the drying of dishes.

The dishwasher may include a latch releasably retaining the door at the seal position. The latch may provide a manual operator releasing a connection to the electronic actuator holding the door in the seal position.

Thus it is an object of possibly another embodiment of the invention to allow opening of the door without the need to actuate or wait for the electronic actuator.

The latch may include a switch signaling that the latch has released the door.

Thus it is another object of the invention to provide information about the state of the door independent from that indicated by the actuator so as to reset the actuator or minimize surge pressures when the door is reclosed, or for other purposes.

The dishwasher may include a detent providing a force releasably holding the door at the close position.

Thus, it is another object of an embodiment of the invention to provide the user of the dishwasher with a positive indication that the door is properly positioned before sealing.

The dishwasher may include a door presence sensor sensing that the door is in the close position to allow the actuator to move the door from the close position to the seal position.

Thus, it is another object of an embodiment of the invention to provide an extremely simple control for electric closure of the door. At certain times in the wash cycle, simply positioning the door in the proper position can cause the door to automatically seal.

The dishwasher may include a sensor sensing an opening force on the door and causing the electric actuator to move the door from the seal position toward the open position.

Thus, it is another object of an embodiment of the invention to provide a simple intuitive control allowing the user to unseal the door simply by pulling on the door such as may be sensed by the sensor.

The dishwasher may include a force sensor sensing a force resisting closure of the door to cause the electric actuator to move the door from the seal position toward the open position. Alternatively, the electric actuator may be force limited, limiting a force of closure of the door between the close position and the seal position.

Thus, it is another object of an embodiment of the invention to accommodate possible jamming of the door such as may be caused, for example, by cutlery that has fallen between the door and the washing chamber.

The invention may be implemented as a latch having interacting door and tub positioned latch portions retaining the door at a vent position between the open and close positions allowing venting of the washing chamber around the door or retaining the door at a seal position to seal water within the washing chamber. The electric actuator may respond to an electric signal to move the door latch from the vent to the seal positions.

Thus, it is another object of an embodiment of the invention to provide a simple method of closing a door through movement of a latch assembly.

In the close position, the door may remain proximate to the washing chamber to block viewing of the washing chamber.

Thus, it is another object of an embodiment of the invention to provide for a dishwasher that is visibly closed for esthetic purposes while maintaining a venting during drying of the dishes or after that time.

These particular objects and advantages apply to only some embodiments falling within the claims, and thus do not define the scope of the invention.

DETAILED DESCRIPTION OF THE PREFERRED EMBODIMENT

Figure 1:
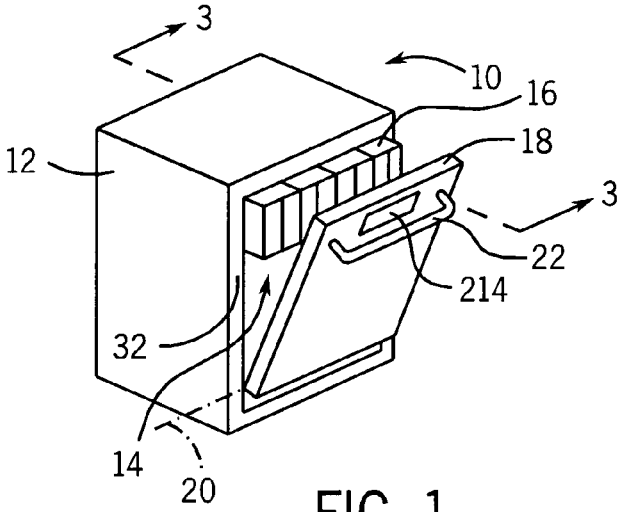
FIG. 1 is a perspective view of a dishwasher suitable for use with the present invention showing a door opening to reveal a washing chamber.

Referring now to FIG. 1, a dishwasher 10 includes a housing 12 partially enclosing a washing chamber 14, the latter holding racks 16 for suspending dishes and cutlery in the washing chamber 14. An open side of the washing chamber may be covered by a door 18 hinged to the housing 12 at a lower edge along a horizontal hinge axis 20. A front surface of the door 18 may include a towel bar 22, or in addition or alternatively, a door release lever 214.

Figure 2:
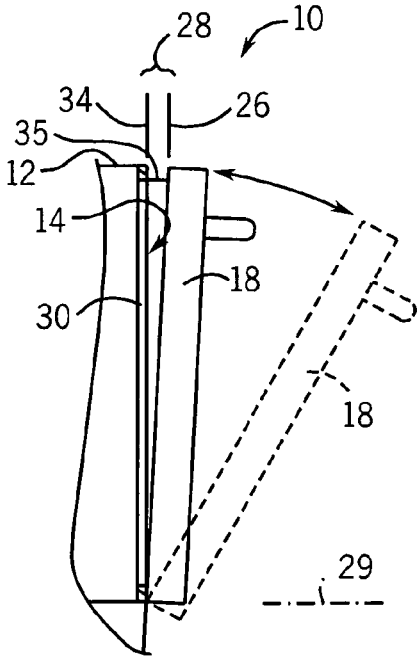
FIG. 2 is a side elevational view of the door of FIG. 1 showing closing of the door to a close position in which the door is spaced from the washing chamber to provide a venting space.

Referring to FIG. 2, the door 18 may swing between an open position 29 shown in phantom and a close position 26, in which the door 18 visually covers the washing chamber 14 but in fact is slightly displaced from a front lip 32 of the washing chamber 14 to provide a venting gap 28. The venting gap 28 may be, for example, a ¼-inch gap between the rear face of the door 18 and a gasket 30, the latter that provides a seal between the door 18 and front lip 32 of the washing chamber 14. The door 18 is held at this close position 26 prior to sealing of the gasket 30 by an electrically operable latching mechanism 35 releasably engaging the housing 12 and door 18, two embodiments of which will be described further below. Generally, the open position 29 will be considered to include a range of positions further opened than the close position 26.

Door Mounted Actuator

Figure 3:
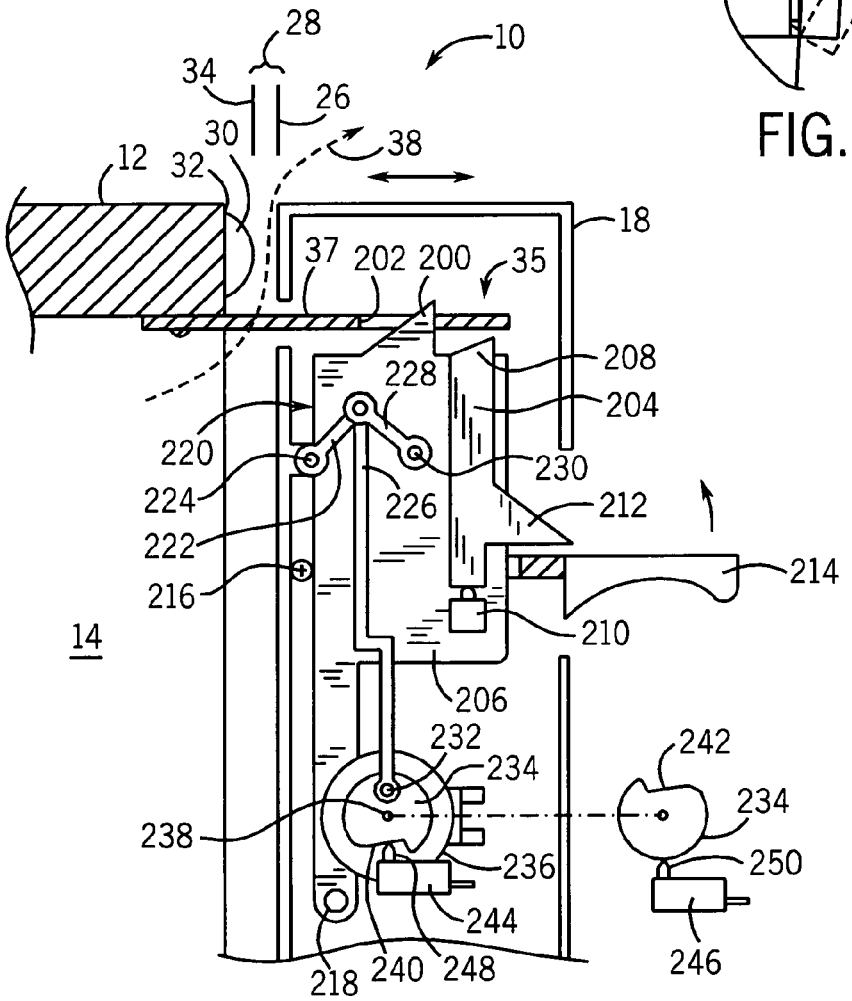
FIG. 3 is a fragmentary, cross-sectional view of the door of FIG. 2 taken along lines 3-3 of FIG. 1 showing the holding of the door in the close position by a bolt mechanism.

Referring now to FIG. 3, when the door 18 is in the close position 26, the venting gap 28 provides a passage for moist air 38 between the front lip 32 of the door 18 and gasket 30 at the conclusion of the washing cycle, before a resumption of the washing cycle, when the washing cycle is interrupted, and during periods when the dishwasher 10 is not in use.

While the venting gap 28 is relatively narrow, the effective open area for free ventilation in and out of the washing chamber 14 may be easily 10 square inches or more to provide improved ventilation over that normally obtained with through-door vents. Further, this total area of venting may be easily increased with only a minor increase in venting gap 28. By opening the door to vent the washing chamber, the space normally needed for a venting mechanism, and in particular for automatic vents that open and close to control sound emissions, can be freed for other use.

Figure 4:
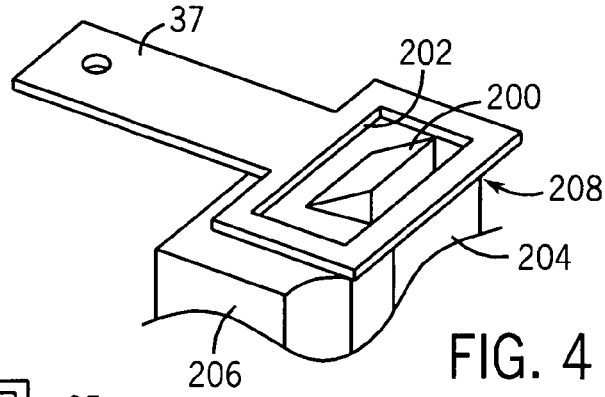
FIG. 4 is a perspective view of a flexible hasp attached to the washing chamber to engage the bolt mechanism of FIG. 2.

Referring now to FIGS. 3 and 4, when the door 18 is first moved from the open position 29 to the close position 26, a flexible hasp 37 having one end attached to the washing chamber 14, extends partially through a slot into the door 18. Within the door 18, a forward edge of the hasp 37 rides up over a ramped, rear face of an upwardly extending bolt 200 until an eye 202 of the hasp 37 aligns with the bolt 200. At this time, the hasp 37 flexes downward capturing the bolt 200 with a vertical frontward face of the bolt 200 abutting an inner edge of the eye 202 resisting opening of the door. The downward engagement of the hasp 37 over the bolt 200 may be provided by the natural flexing of the material of the hasp 37. The hasp 37 and the bolt 200 together form part of a latching mechanism 35.

The bolt 200 is supported by a bolt block 206 which is pivoted with respect to the door 18 about pivot point 218 positioned below bolt 200 and providing a pivot axis generally parallel to an inner face of the door 18. Pivoting of the bolt block 206 thus moves bolt 200 toward or away from the washing chamber 14.

The pivoting of the bolt block 206 is controlled by a toggle joint 220 having a first linkage bar 222 pivotally connected at a first end to a point 224 on an inner edge of the door 18 and pivotally attached at a second end to an upper end of vertically extending tie arm 226 and to a first end of second linkage bar 228. The second end of second linkage bar 228 attaches pivotally at point 230 on the bolt block 206. Toggle joint 220 bends like an elbow when the first end of the vertical tie arm 226 moves upward pulling the bolt block 206 and bolt 200 toward the washing chamber 14 and straightens again when the first end of the vertical tie arm 226 moves downward pushing the bolt block 206 and bolt 200 away from the washing chamber 14.

The lower end of the vertical tie arm 226 attaches to a crank arm formed by pivot point 232 eccentrically mounted on cam disk 234 rotatable by motor 236 about axis 238. Accordingly rotation of the motor 236 causes the vertical tie arm 226 to move upward and downward moving the bolt 200 within the door toward and away from the washing chamber 14.

Figure 6:
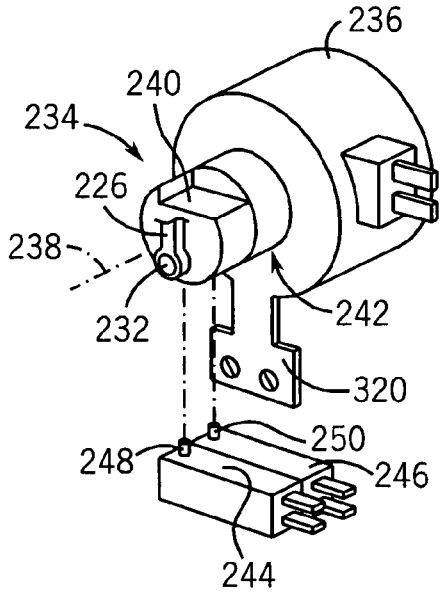
FIG. 6 is a perspective view of a motor cam system moving the door between the seal and close positions.

Referring also to FIG. 6, cam disk 234 is generally cylindrical and attached at its axis to a shaft (not shown) of the motor 236 to rotate about an axis 238. The cam disk 234 provides at its periphery, a first flat 240 away from the motor 236 and second flat 242 toward the motor 236, each of flats 240 and 242 displaced from each other about the axis 238 of the motor 236 at approximately 180° with respect to each other.

A pair of limit switches 244 and 246 have operators 248 and 250 positioned, respectively, to align with the flats 240 and 244 as the cam disk 234 rotates to be separately actuated thereby. In the close position 26 shown in FIG. 3, vertical tie arm 226 is at its highest position and flat 240 is adjacent to operator 248 (allowing release of the operator 248 of switch 244) where as flat 242 is displaced from the operator 250 (depressing operator 250 of switch 246). At the vertical tie arm's highest position, the arms of the toggle joint 220 are bent and pivot points 224 and 230 are drawn together moving bolt block 206 toward the rear of the door 18 creating the venting gap 28.

While a toggle joint 220 is described for opening an closing the door, it will be understood to those of ordinary skill in the art, from this description, that other mechanism may also be used including, for example, a single arm and roller pivoting on one of the door and frame and rolling against a flat on the other of the door and frame. Other mechanisms such as cams, wedges, gears and interengaging threaded members may also be used.

Figure 5:
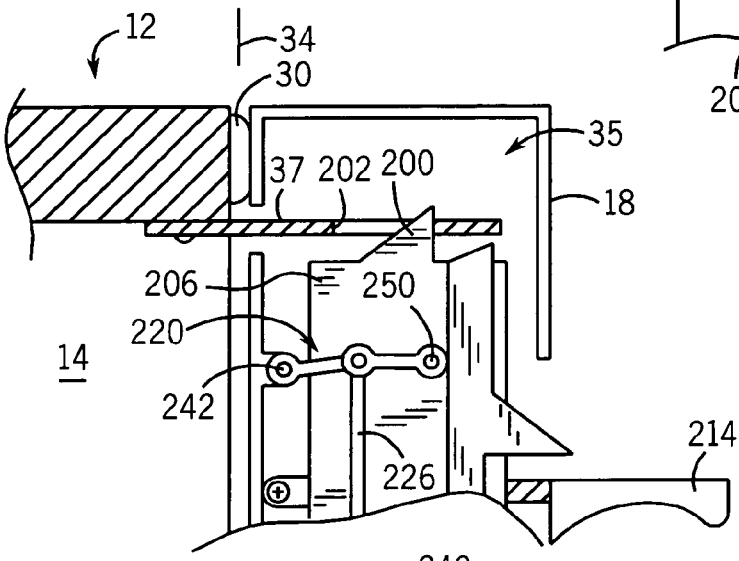
FIG. 5 is a figure similar to that of FIG. 3 showing the door in the seal position.
Figure 5:
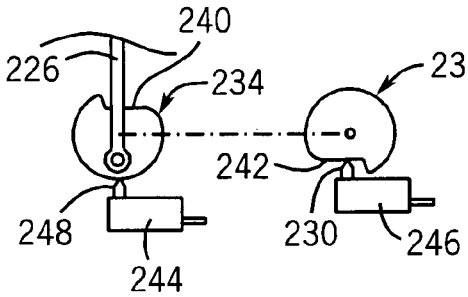

Referring now to FIG. 5, once the dishwasher 10 is loaded with dishes and it is desired to wash the dishes, the motor 236 can be actuated to rotate the cam disk 234. This rotation causes an activation of operator 248 of switch 244 and continues until operator 250 of switch 246 is released by alignment of the flat 242 with the operator 250 after approximately 180° of motor rotation. At this time, the operator of switch 244 is fully depressed and the vertical tie arm 226 is in its lowermost position. At the vertical tie arm's lowest position, the arms of the toggle joint 220 are straightened and pivot points 224 and 230 are separated moving bolt block 206 toward the front of the door 18. This movement causes bolt 200 to pull hasp 37 into the door drawing the door 18 to the washing chamber 14 by compressing gasket 30 as the door moves to the seal position 34. At this time washing may commence.

Figure 8:
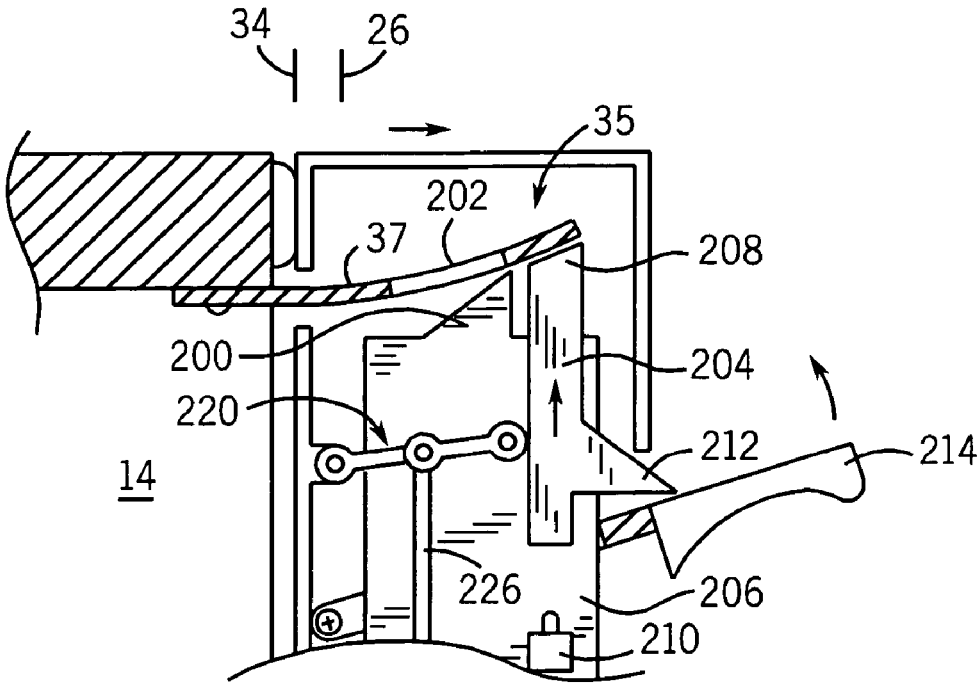
FIG. 8 is a figure similar to that of FIG. 5 showing manual release of the door from the closed or seal positions.

Referring now to FIG. 8, the bolt block 206 supporting bolt 200, also supports a hasp release bar 204 slidably attached to a bolt block 206 forward of the bolt 200 to move vertically thereon. When the hasp 37 is engaged with the bolt 200 as shown in FIG. 3, and the release bar 204 is in its lowest position, an upper end 208 of the hasp release bar 204 is below and adjacent to a front edge of the hasp 37 forward from the bolt 200. At this time, a lower end of the release bar 204 presses downward on a switch 210 providing an indication that the hasp 37 is engaged with the bolt 200 and hence, that the door 18 is in the close position 26. The flex of the material of the hasp 37 is sufficient to press the hasp release bar 204 downward against the switch 210 activating it, however, additional biasing springs may be provided if necessary as will be understood to those or ordinary skill in the art.

The hasp release bar 204 includes an actuation arm 212 extending laterally therefrom which may engage an upper surface of a door release lever 214. As shown in FIG. 8, the door release lever 214 pivots about a pivot point 216 affixed to the inner surface of the door 18 to press upward on arm 212 when the door release lever 214 is raised. This raising of the door release lever 214 thus moves hasp release bar 204 upward causing upper end 208 to push upward on the hasp 37 disengaging it from bolt 200. This, in turn, releases the bolt 200 from the eye 202 and allows immediate opening of the door 18 from the seal position 34 or close position 26.

This upward motion of the hasp release bar 204 causes its lower end to move away from switch 210 providing a signal to the timer control circuitry that the door is about to be opened. In the preferred embodiment, this signal produced by switch 210 activates the motor 236 (shown in FIG. 6) moving the vertical tie arm 226 upward to bend the toggle joint 220 so as to draw the bolt 200 back toward the washing chamber 14 where it may engage the hasp 37 when the user subsequently closes the door 18.

Figure 9:
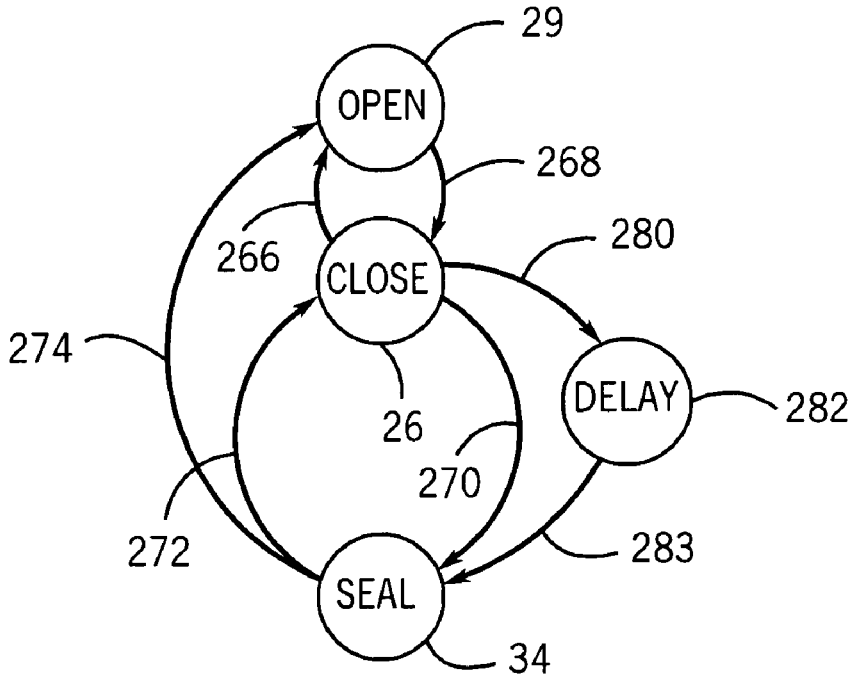
FIG. 9 is state diagram showing control logic programmed into a dishwasher controller to provide for surge pressure control.

Referring now to FIG. 9, the movement of the door 18 via electrically actuated latching mechanism 35 may be controlled by dishwasher control circuitry (not shown) of a type well known in the art, including a microprocessor-based control circuitry, receiving inputs from switches 244, 246, and 210 and providing power to motor 236. Such control circuitry manages the timing and sequence of movement of the latching mechanism 35 as it interacts with movement of the door 18 among the open position 29 in which dishes may be freely loaded, the close position 26 as shown in FIG. 3 and the seal position 34 as shown in FIG. 5. These latter two states of seal and close will also denote states of the latching mechanism 35.

Generally, the door may move from the close position 26 to the open position 29 by activation of the door release lever 214 as indicated by arrow 266 with the user pulling the door 18 downward possibly against a counterbalancing spring. Likewise as indicated by arrow 268, the user may move the door 18 from the open position 29 to the close position 26 engaging the hasp 37 with the bolt 200 as has previously been described.

Movement of the door 18 and latching mechanism 35 from the close position 26 to the seal position 34 is initiated as indicated by arrow 270 upon occurrence of a wash signal from the dishwasher control circuitry. Conversely as indicated by arrow 272, motion of the door 18 and latching mechanism 35 from the seal position 34 to the close position 26 may occur when a vent signal is received from the dishwasher control circuitry.

Alternatively as indicated by arrow 274, the door 18 may move from the seal position 34 to the open position 29 by operation of the lever 214. In this case, the dishwasher control circuitry must respond to the open signal developed by switch 210 to move the latch mechanism 25 to the close position 26 to be able to receive the door 18 as closed by the user per arrow 268.

Finally, the movement of the door 18 from the seal position 34 to the open position 29 per arrow 274 may occur during the wash cycle. In this case, heated air will escape from the washing chamber 14 to be replaced by cool air creating the possibility, if the door 18 is sealed shortly thereafter, that the contained cool air will expand forcing water out of the washing chamber 14 past the gaskets 30.

Accordingly, in one embodiment of the invention, the dishwasher control circuitry introduce, as indicated by arrow 280, a delay state 282 in which heating of the contained air is allowed to occur with the door in the venting or close position 26 until temperature and pressure equilibrium is obtained. Only after this, as indicated by arrow 283, the door is sealed to the seal position 34.

Referring to FIGS. 3, 5, 7, and 9, the latch of the present invention may also work without additional control circuitry beyond what is found in a standard dishwasher by making use of a logical network provided by single throw, double pole switches 244, 246, and 210 described above. In this embodiment, a standard timer control 286 may provide a connection of power 288 to one of a VENT pole 290 (normally connected to an electronic door vent) and a WASH pole 292 (normally connected to the wash mechanism. This connection may be either through the use of a mechanical switch, relay contacts, or solid-state circuitry well known in the art.

The WASH pole 292 may be connected to the throw of switch 210 which may either be connected to an OPEN pole 294 or CLOSE pole 296. OPEN pole 294 may also be connected to VENT pole 290 and to one pole 298 of switch 246. The CLOSE pole 296 may be connected to one pole 300 of switch 244. Throws of switches 244 and 246 may connect to one terminal of the motor 236 and the remaining terminal may connect to a power return via line 302.

During the wash cycle when the door 18 is closed, power 288 will pass from the WASH pole 292 through switch 210 to the CLOSE pole 296 to pole 300 of switch 244. When the latching mechanism 35 is in the seal position 34, the throw of switch 244 does not connect to the pole 300 while throw of switch 246 is connected to the pole 298. No power is connected to the motor 236. This is the configuration shown in FIG. 5.

At the conclusion of the wash cycle, the timer control 286 provides power to VENT pole 290. Pole 298 now receives power causing motor 236 to move until the cam disk 234 disconnects the throw of switch 246 from pole 298 stopping the motor 236 in the configuration shown in FIG. 3. The motor 236 and door 18 remain in this state until a new wash signal is received.

Alternatively, assuming the wash cycle is underway, if switch 210 is activated caused by manual release of the door through lever 214, power will flow from WASH pole 292 to OPEN pole 294, then to pole 298 causing actuation of the motor 236 to move the latching mechanism 35 to the close position 26. This causes a switching of the throws of switch 244 and 246 and when the door 18 is again closed and switch 210 has its throw moved to the close position, power will again be received by motor 236 through pole 300 causing sealing of the door 18.

Motorized closure of the door 18 allows the dishwasher to remain in the vented state between uses reducing residual moisture and undue compression of the gaskets 30. Motorized actuation of the door 18 both in sealing and in releasing allows the door 18 to stand in for more sophisticated venting systems such as those described in U.S. Pat. No. 6,293,289.

Referring again to FIG. 6, the motor 236 may be mounted to the door 18 by a flexible mounting 320 allowing tipping of the axis 238 under predetermined force. Further, vertical tie arm 226 may have some flexure in compression. Thus it will be understood that the force of sealing of the door may be readily limited and that in the event of a jam of the door 18 preventing it from moving to the seal position 34, the forces of the motor 236 may be dissipated in flexure of the mounting to 320 and of the tie vertical tie arm 226.

Washing Chamber Mounted Actuator

Figure 10:
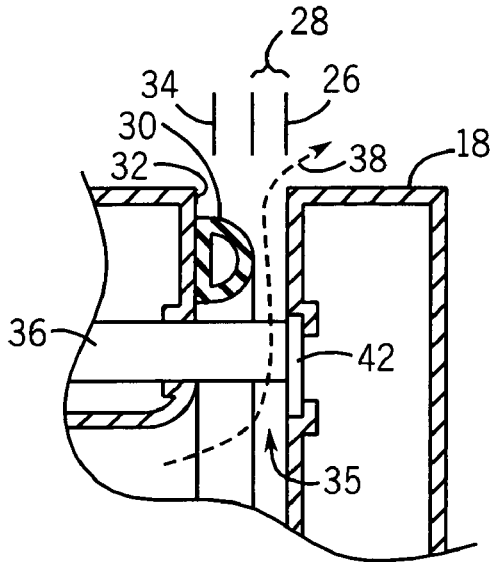
FIG. 10 is a fragmentary, cross-sectional view of the door of FIG. 2 showing the holding of the door in the close position by a bolt mechanism for a cabinet mounted version of the invention.

Referring now to FIG. 10, when the door 18 is in the close position 26, again the venting gap 28 provides a passage for moist air 38 between the front lip 32 of the door 18 and the gasket 30 as held by a latching mechanism 35 provided by a movable bolt assembly 36.

Figure 11:
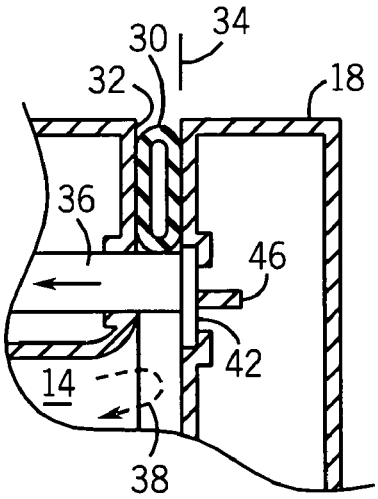
FIG. 11 is a figure similar to that of FIG. 10 showing the door drawn to a seal position by movement inward of the bolt mechanism.

Referring now to FIG. 11, after the door 18 is in the close position, the bolt assembly 36 may be retracted to draw the door 18 into a seal position 34. When the door 18 is in the seal position 34, the gasket 30 is compressed between the rear face of the door 18 and the front lip 32 of the washing chamber 14, sealing the moist air 38 and water within the washing chamber 14.

Figure 12:
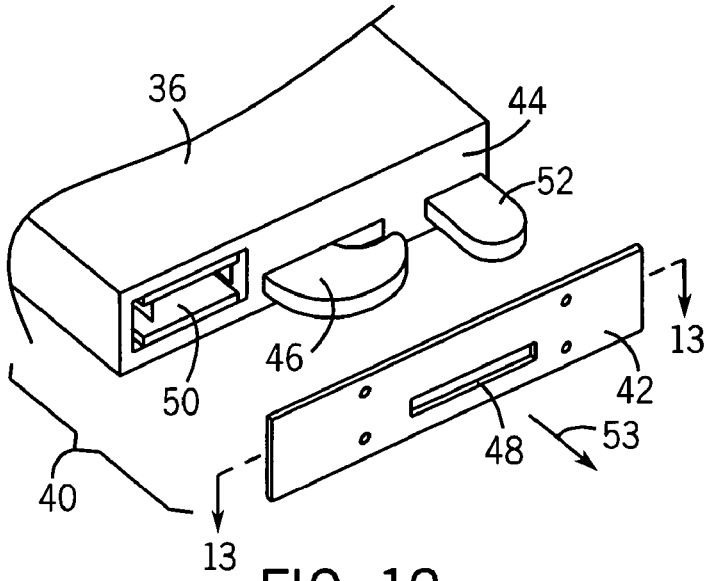
FIG. 12 is a perspective view of the bolt mechanism of FIGS. 3 and 4 positioned near a strike plate that may be attached to the door.

Referring now to FIG. 12, the bolt assembly 36 attached to the housing 12, forms part of a latch 40 together with strike plate 42 attached to an inner surface of the top edge of the door 18. When the door 18 is in the close position, a faceplate 44 of the bolt assembly 36 abuts the strike plate 42. A hook bolt 46 from the bolt assembly 36 may engage a corresponding slot 48 of the strike plate 42 holding the faceplate 44 and strike plate 42 in abutment.

The faceplate 44 also includes an aperture exposing a magnetic cabinet latch 50 that may attach by magnetic attraction to the magnetic surface (e.g., unmagnetized steel) of the strike plate 42, and a door-sensing plunger 52 which is pressed inward by the strike plate 42 when it abuts the faceplate 44 of the bolt assembly 36. Other releasable latches may be used instead of the magnetic cabinet latch, including spring-type cabinet latches and the like.

Referring again to FIG. 1 initially, the door 18 may be in the open position 29 for adding or removing dishes and adding detergent, for example, to a door dispenser (not shown). The door 18 may then be moved to the close position 26 where it is held by the magnetic cabinet latch 50 which provides an approximately eight pound retention force. The door-sensing plunger 52 is compressed indicating that the door 18 is ready for sealing as is communicated to a switch to be described below.

The force of the magnetic cabinet latch 50 may be easily overcome by the user grasping the towel bar 22 and in this way, the door 18 may again be opened for repeated access to the washing chamber 14. The door 18 may further include balance springs as is known in the art offsetting, augmenting, or supplanting the force of the magnetic cabinet latch 50.

When the door 18 is closed by the user, it stops at the close position 26 because of the abutment of the strike plate 42 and the faceplate 44 of the bolt assembly 36. At this time, the user may initiate the wash cycle of the dishwasher using standard controls contained on the door or elsewhere such as communicate with a timer/controller circuit.

Referring to FIG. 11, the activation of the wash cycle when the door 18 is in the close position 26 causes an engagement of the hook bolt 46 from the bolt assembly 36 with the strike plate 42 and a retraction of the bolt assembly 36 drawing the door into the seal position 34. The engagement of the hook bolt 46 with strike plate 42 allows greater force to be applied to the door 18 to compress gasket 30 than is possible using the magnetic cabinet latch 50 alone. Hot water and detergent are then sprayed about the interior of the washing chamber 14 to clean the contained dishes and cutlery with leakage past the door 18 prevented by the compressed gasket.

During a succeeding drying period, the bolt assembly 36 extends outward again, as shown in FIG. 10, allowing for venting of moist air 38 and improved drying of the contained dishes and cutlery.

Figure 13:
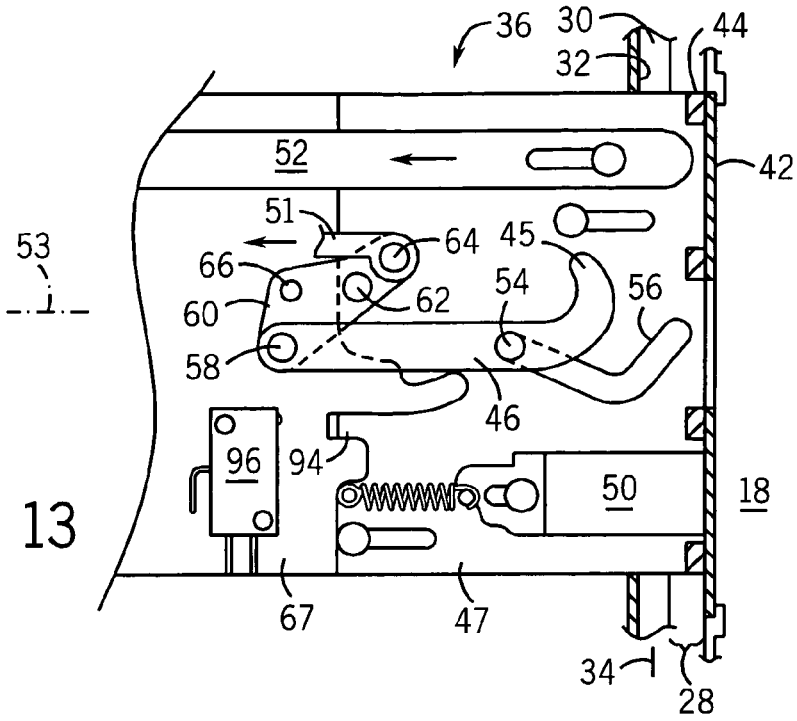
FIG. 13 is a plan view of the bolt mechanism in cutaway taken along lines 13-13 of FIG. 12 showing an initial state in which the door is in the close position with the strike plate abutting the bolt mechanism.

Referring now to FIG. 13, when the door 18 is first moved to the close position 26, the hook bolt 46 is contained within the housing of the bolt assembly 36 behind the faceplate 44 of the bolt assembly 36, the strike plate 42 abuts the faceplate 44, and the door-sensing plunger 52 is depressed inward.

The hook bolt 46 may be a planar strip of metal extending generally along the longitudinal axis 53 and having a hook 45 at its end closest to the faceplate 44. The hook bolt 46 lies against and slides generally along a horizontal mounting plate 47 of the bolt assembly 36 attached near the hook 45 by a traveling rivet 54 which engages a curved slot 56 in the mounting plate 47. The curved slot 56 is shaped to cause the hook 45 of the hook bolt 46 to move in a generally arcuate manner to pass through the slot 48 in the strike plate 42 and then to move perpendicular to the longitudinal axis 53 to engage in an inner edge of the strike plate 42 obverse to the edge of the strike plate 42 abutting the faceplate 44.

Figure 14:
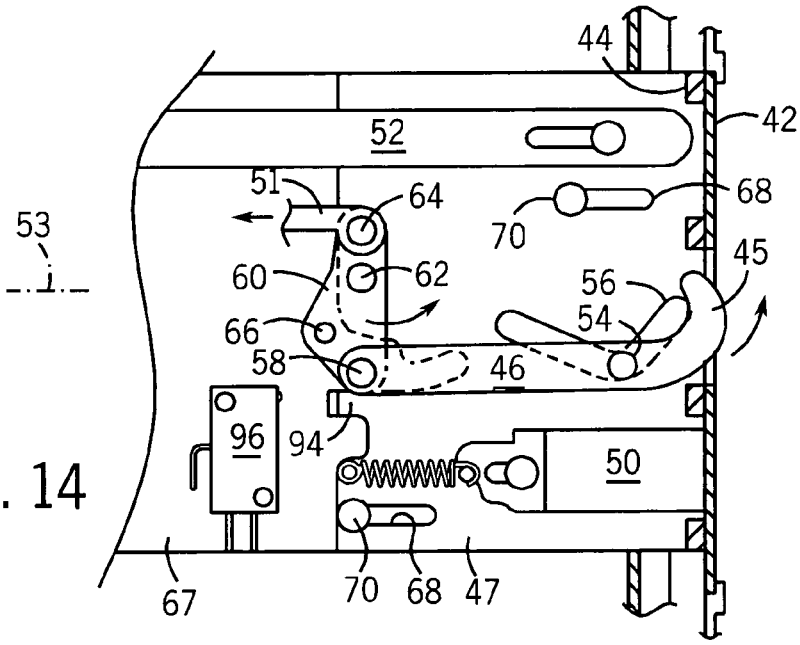
FIG. 14 is a figure similar to that of FIG. 13 showing the bolt mechanism in a second state where the hook bolt has extended through a strike plate hole to retain the strike plate against the bolt mechanism.

Referring now to FIG. 14, a rearward end of the hook bolt 46 is attached by pivot pin 58 to a toggle arm 60 which in turn pivots about toggle axle 62 attached to mounting plate 47. An actuator arm 51 extending along longitudinal axis 53 is attached at pivot pin 64 to the toggle arm 60 at a point opposite pivot pin 58 with respect to toggle axle 62. Thus generally, rearward motion of the linear actuator arm 51 along the longitudinal axis 53 causes counterclockwise rotation of the toggle arm 60 moving pivot pin 58 imparting forward motion to the hook bolt 46. This forward motion in turn causes the hook bolt 46 to pass through the slot 48 in the strike plate 42, then to move laterally to engage a rear surface of the strike plate 42.

Referring now to FIGS. 8 and 9, the linear actuator arm 51 provides a vertically extending heel plate 72 that may be engaged by a linear actuator (not shown, but to be described below). The heel plate 72 is part of a longitudinally extending first slider portion 74. A second slider portion 76, also longitudinally extending, is connected to the first slider portion 74 to slide with respect to the first slider portion 74 in linear fashion as retained by a tongue and slot 78 and 80 and slot and rivet 82 and 84. The sliding portions 74 and 76 are drawn together in shortened configuration by an extension spring 90 but may be separated by force sufficient to extend extension spring 90. Slider portion 76 includes eye 92 that attaches via pivot pin 64 to the toggle arm 60.

Figure 17:
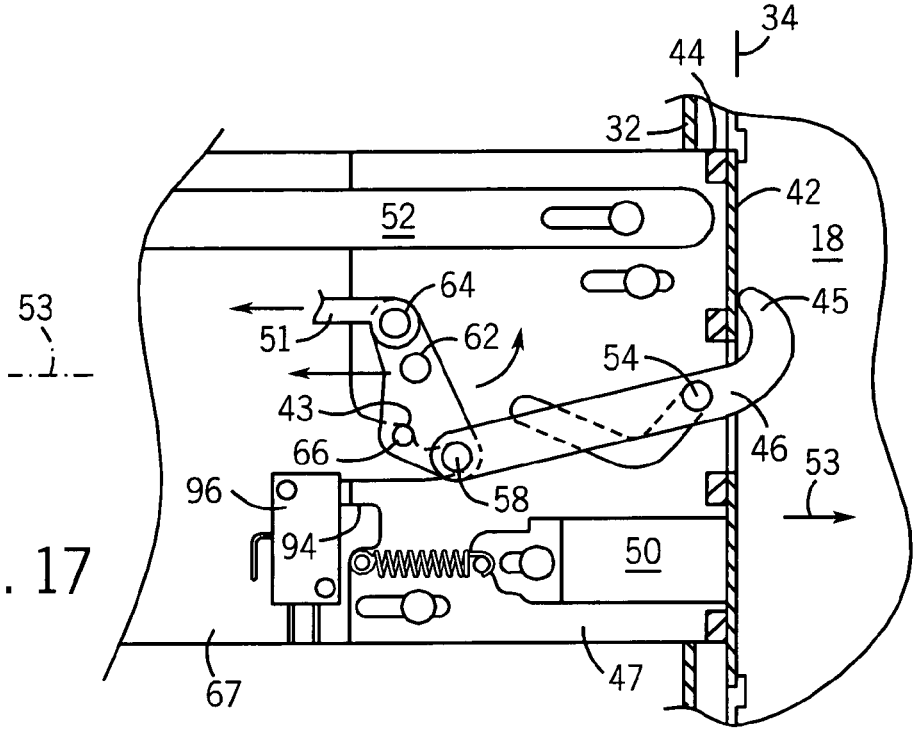
FIG. 17 is a figure similar to that of FIGS. 6 and 7 showing the bolt mechanism in a third state drawing of the door into the seal position.

Referring now to FIG. 17, strike plate 42 is slidably mounted to a mounting plate 47 that is in turn mounted to a wall of the housing 12 so that strike plate 42 and attached faceplate 44 may move in the longitudinal axis 53 with respect to support plate 67. This relative sliding motion of strike plate 42 with respect to support plate 67 is constrained by guide slots 68 cut in strike plate 42 through which shoulder rivets 70 pass to retain strike plate 42 to support plate 67.

Toggle arm 60 includes a downward extending cam pin 66 that rotates with rotation of the toggle arm 60. With sufficient rotation of the toggle arm 60 to fully extend hook bolt 46 so that hook 45 has extended through the slot 48 and behind the strike plate 42, the cam pin 66 abuts a rear surface 43 of the strike plate 42 preventing further rotation. Additional retraction of linear actuator arm 51 then causes a rearward sliding of the mounting plate 47 with respect to support plate 67 pulling the faceplate 44 inward. Because the faceplate 44 is held adjacent to the strike plate 42 by the hook 45, the inward motion of the faceplate 44 pulls the strike plate 42 and door 18 to the seal position 34. The force of the retraction is transmitted by the engagement of the hook bolt 46 with the strike plate 42 and does not rely on the magnetic attraction of the magnetic cabinet latch 50.

With the rearward sliding of the mounting plate 47 with respect to support plate 67, finger extension 94 on the mounting plate 47 may close a micro switch 96 mounted on support plate 67 providing an indication of the sealing of the door.

Figure 7:
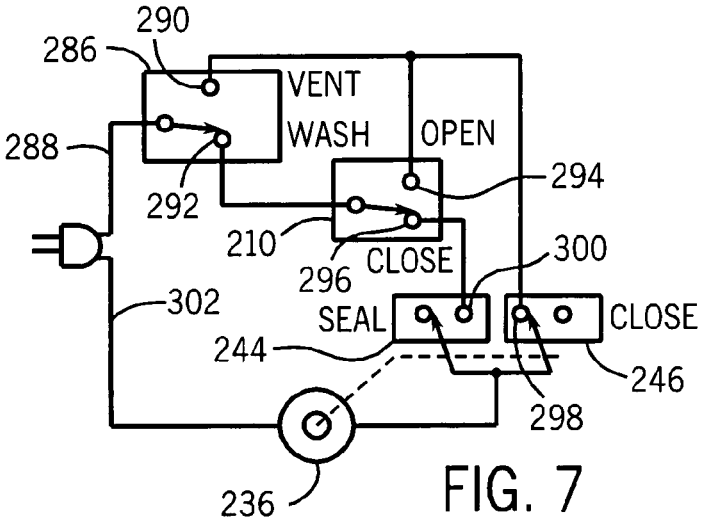
FIG. 7 is an electrical schematic of a circuit that may be used to control the motor of FIG. 6.
Figure 15:
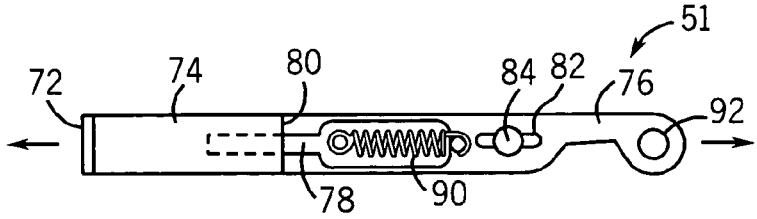
FIG. 15 is a top plan view of a linear actuator arm used to move the hook bolt.
Figure 16:
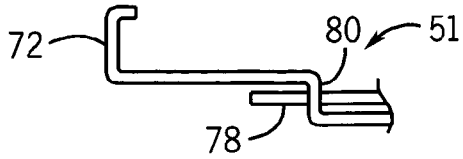
FIG. 16 is a side elevational view of the linear actuator arm of FIG. 15.

Referring still to FIG. 17, after the door 18 is in the seal position 34, forward pressure along the longitudinal axis 53, for example, caused by a pulling of the towel bar 22, will cause strike plate 42 to pull slightly away from the lip 32 of the washing chamber 14. This is accomplished by a stretching extension spring 90 of the linear actuator arm 51 (shown in FIG. 15) such as allows forward sliding of the mounting plate 47 with respect to the support plate 67 on which the linear actuator is mounted. This sliding causes disengagement of the finger extension 94 from the operator of the micro switch 96 sending a signal to the timer/controller indicating that the user wishes to open the door. Generally, the process described with respect to FIGS. 6, 7, and 10 is reversed to release the door.

It will be understood from this description that if micro switch 96 is not closed after conclusion of the retraction of linear actuator arm 51, this may indicate a jamming of the door 18 or failure in some part of the sealing mechanism and the door 18 may be in such cases also reopened by reversing actuation of linear actuator arm 51. Such jam may be caused, for example, by cutlery falling between the door and wash chamber before closing. Thus, the same mechanism may be used to provide both a response to jamming and a pull on the door 18 by a user.

Figure 18:
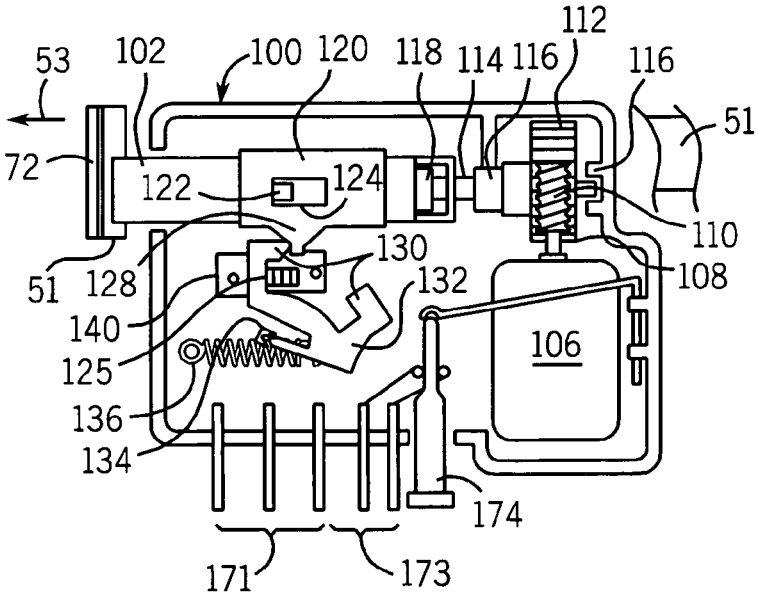
FIG. 18 is a cutaway view of an electric linear actuator such as provides simple bi-directional linear motion for moving the hook bolt through the linear actuator.

The linear actuator arm 51 may be moved by a variety of well known actuators, including but not limited to wax motors, solenoids, crank arms on rotating motors (per the door mounted embodiment) and the like. However, in the preferred embodiment, the linear actuator arm 51 is moved by a motor driven linear actuator 100 as shown in FIG. 18.

Linear actuator 100 includes an extension arm 102 that may press against the heel plate 72 of the linear actuator arm 51 to move it along the longitudinal axis 53. The linear actuator 100 holds a direct current motor 106 having a shaft 108 extending perpendicularly to the longitudinal axis 53 and holding a worm gear 110 on its end. The worm gear 110 engages a spur gear 112 attached to a threaded shaft 114. The shaft 114 extends in the longitudinal direction and is supported by bearings 116 attached to the housing of the linear actuator 100 so as to rotate with rotation of the spur gear 112 as driven by the motor 106.

Shaft 114 passes through the actuator extension arm 102 to be received therein by a standard hex nut 118 fixed to the extension arm 102. Accordingly, rotation of the shaft 114 drives the nut 118 to move the extension arm 102 leftward or rightward along the longitudinal axis 53. The worm gear 110, spur gear 112, threaded shaft 114, and hex nut 118 are selected to provide the necessary mechanical advantage needed to seal the door 18.

A slidable saddle 120 fits on top of the extension arm 102 to slide there along restrained by inter-fitting boss 122 of the extension arm 102 and slot 124 in the saddle 120. A cantilever 128 extends from the saddle 120 to fit between opposing teeth 130 of a rocker 132 pivoting about a pivot 134 to rock back and forth as moved by the cantilever 128 with movement of the saddle 120 as engages the extension arm 102.

Figure 19:
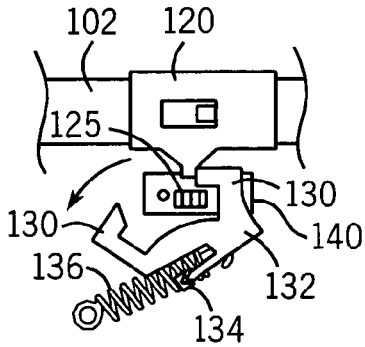
FIG. 19 is a detailed view of a bi-stable mechanical toggle inside the linear actuator of FIG. 17 limiting motion of the actuator.

An extension spring 136 attaches between a housing of the linear actuator 100 and the rocker 132 so as to cause the rocker to be bi-stable between a first position in its full clockwise rotation as shown in FIG. 18 and a second position in its full counterclockwise rotation as shown in FIG. 19. In the first clockwise position, an undercut beneath a first tooth 130 catches on an upwardly extending operator 125 of a double pole, double throw slide switch 140 pushing that operator 125 to its extreme rightward position. In the second counterclockwise position, a similar undercut beneath a second tooth 130 pushes the operator 125 to its extreme leftward position. The rocker 132 thus serves to cause the switch 140 to be quickly switched between its two throw positions at a rate faster than movement of the cantilever 128 would do directly.

Thus, when activation of the motor 106 causes the extension arm 102 to move leftward from the rightmost position shown in FIG. 18, the cantilever 128 presses against tooth 130 until extension spring 136 crosses the pivot 134 whereupon the rocker 132 snaps quickly to the extreme counterclockwise direction pulling the operator of the switch 140 leftward. During this snap, the unengaged tooth 130 may catch the slowly moving cantilever 128, but simply causes a sliding of the saddle 120 on the extension arm 102 as allowed by slot 124 so that cantilever 128 does not interfere with this rapid snapping action.

As will be described below, the switch 140 may be connected to the motor 106 so as to stop further motion of the motor 106 moving the extension arm 102 leftward. Further activation of the motor 106 must then be to cause the extension arm 102 to move rightward. When it does so, the cantilever 128 presses against tooth 130 until extension spring 136 crosses the pivot 134 again causing the rocker 132 to snap, this time to the extreme clockwise direction, pulling the operator of the switch 140 leftward.

Figure 20:
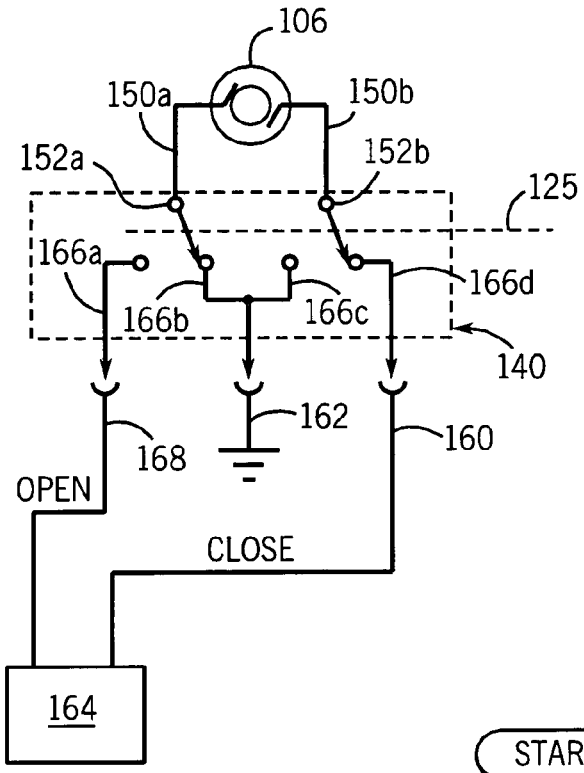
FIG. 20 is a schematic diagram of an electrical connection between the linear actuator of FIGS. 19 and 20 and a timer/controller such as may operate the door of the present invention.
Figure 21:
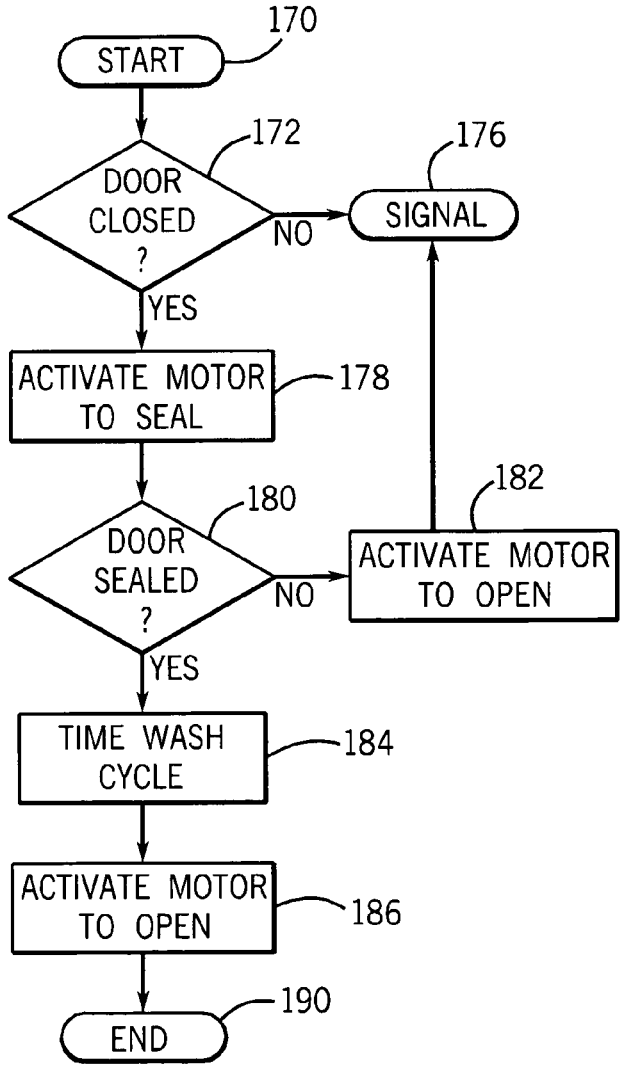
FIG. 21 is a flow chart showing operation of the timer/controller of FIG. 20.

Referring now to FIG. 20, the motor 106 provides two leads 150*a* and 150*b* which may be connected to first and second throws 152*a* and 152*b* of the switch 140. When the operator 125 is in the rightmost position per FIG. 18, the throws 152*a* and 152*b* connect to a first set of poles 166*a*-*d*. Throw 152*a* connects to pole 166*b* leading to ground 162, and throw 152*b* connects to pole 166*d* leading to a "close" signal line 160. A positive voltage applied to the "close" signal line 160, for example, by a timer/controller 164 will cause motion of the motor 106 to move the switch operator 125 (by the snap action process described above) so that throw 152*a* connects to pole 166*a* leading to an "open" signal line 168 and throw 152*b* connects to pole 166*c* leading to ground 162.

Thus, when the switch 140 is in its rightmost position as shown in FIG. 20 and corresponding with door 18 being unsealed, the "open" signal line 168 has been disconnected from the motor 104 and the motor will only receive a signal on "close" signal line 160 (e.g., a positive voltage). Such an "open" signal causes the motor 104 to move to seal the door 18 until the switch changes state, moving to a leftmost position, and disconnecting motor 104 from the "close" signal line 160 whereupon the motor 104 stops.

An "open" signal being a positive voltage asserted on "open" signal line 168 causes reversal of the motor moving extension arm 102 rightward causing an unsealing of the door until the switch changes state, moving to a rightmost position, and disconnecting motor 104 from the "open" signal line 168 whereupon the motor 104 again stops.

The switch 140 thus effects both a stopping of the motor 104 at the limits of its travel independent of the duration of the applied voltage on "open" or "close" signal lines 160 and 168, and reverses the wiring of the motor by connecting the motor 104 to the line lines 160 and 168 from which the next signal will be obtained.

Referring momentarily to FIG. 18, only three terminals 171 are thus necessary to fully control the linear actuator 100. Two additional terminals 173 are provided connected to a switch 174 whose operator may communicate with the door-sensing plunger 52 (shown in FIGS. 6, 7, and 10) via a toggle (not shown) to provide a signal through terminals 173 to the timer/controller 164 that the door 18 is in the close position 26.

Referring now to FIGS. 2 and 14, the timer/controller 164 may be activated by the user of the dishwasher 10, for example, by pressing a start dishwasher button as indicated by start block 170. At decision block 172, the control circuitry must decide whether the door is closed. The door 18 being closed is indicated by door-sensing plunger 52 as described above or by other proximity sensing means for example, separate switches, reed relay and magnet combinations and other methods well known in the art.

If the door 18 is not in the close position 26, the user is signaled as indicated by process block 176.

If the door 18 is in the close position 26, however, then the linear actuator 100 may be activated by the controller using "close" signal line 160 (shown in FIG. 20) as indicated by process block 178. The door 18 begins moving toward the seal position 34.

At the conclusion of a predetermined closing period as may be determined by a timer incorporated into the timer/controller 164 or by a signal from the linear actuator 100, the micro switch 96 (shown in FIG. 18) is interrogated as indicated by decision block 180. If the door 18 is not in the seal position 34 as indicated by the micro switch 96, then at process block 182, the linear actuator 100 is reversed by placing a signal on "open" signal line 168 and the user is signaled at process block 176 that door closure could not be complete because of a jam or the like. The ability of actuator arm 51 to extend against its spring 90 ensures that the linear actuator can complete its travel even with the door jammed.

If however, after the predetermined closing period at decision block 180 the door has sealed, as indicated by closure of micro switch 96, then the timer/controller 164 may undertake the normal dishwashing cycle indicated by process block 184.

At the conclusion of that dishwashing cycle of process block 184, the linear actuator 100 is reversed by placing a positive voltage on "close" signal line 160 and the door 18 is returned to the close position 26 allowing venting of the washing chamber 14 as indicated by process block 186. The cycle is then complete as indicated by process block 190.

As will be apparent from this description, the sealing mechanism may be used without the venting feature but by using standard through-door vents or the like. Venting by opening the door may be done after the door is sealed by another means including manually or by a separate mechanism. The actuator may be in the door rather than on the washing chamber side. The door need not be hinged but may use other opening mechanisms well known in the art. The venting may be performed by motion of the hinge side of the door rather than by or in addition to motion of the swinging side of the door. A standard switch can be used instead of door force sensing to cause unsealing of the door. The door may automatically seal when it is in the close position. When a jam is sensed, the door may stop rather than reverse. A mechanism other than the latch may be used to open and close the door including motorized hinges or arms or cable extending between the door and the dishwasher.

It is specifically intended that the present invention not be limited to the embodiments and illustrations contained herein, but include modified forms of those embodiments including portions of the embodiments and combinations of elements of different embodiments as come within the scope of the following claims.

I claim:

1. A dishwasher comprising:

a washing chamber having a door movable from an open position permitting the loading of the washing chamber, through a close position visually covering the washing chamber, to a seal position sealing water within the washing chamber by the compression of a gasket;

a timer/controller generating an electric signal indicating a time for sealing the door for washing;

and an electric actuator responding to the electric signal to move the door from the close position to the seal position to compress the gasket through a force applied to the door by the electric actuator; wherein the electric actuator connects to the door through a releasable latch allowing the electric actuator to be engaged and disengaged from the door;

at least one switch providing a signal confirming engagement of the electric actuator and door, the switch communicating with the timer controller to prevent washing prior to the occurrence of this confirming signal;

and a force sensor sensing a pre-determined force on the electric actuator resisting closure of the door by the electric actuator caused by an obstruction between the door and the washing chamber to controllably stop closure of the door before the seal position.

2. The dishwasher of claim 1 wherein the close position provides a space between the washing chamber and the door allowing venting of the washing chamber.

3. The dishwasher of claim 1 wherein the latch includes a manual operator releasing a connection to the electronic actuator holding the door in the seal position.

4. The dishwasher of claim 3 wherein the latch includes a switch signaling that the latch has released the door.

5. The dishwasher of claim 1 including a detent providing a force releasably holding the door at the close position.

6. The dishwasher of claim 1 including a sensor sensing the door in the close position to allow the electric actuator to move the door from the close position to the seal position.

7. The dishwasher of claim 1 wherein the electric actuator is mounted in the door to releasably engage structure of the washing chamber to move the door between the close position and the seal position.

8. The dishwasher of claim 1 wherein the electric actuator is mounted on the washing chamber to releasably engage structure of the door to move the door between the close position and the seal position.

9. The dishwasher of claim 1 including a sensor sensing an opening force on the door to cause the electric actuator to move the door from the seal position toward the open position.

10. The dishwasher of claim 1 wherein the switch providing a signal confirming engagement of the electric actuator and door provides the signal before the door is in the seal position sealing water within the washing chamber.

11. The dishwasher of claim 1 wherein the force sensor senses a force resisting closure of the door as the door is being automatically closed to cause the electric actuator to move the door away from the seal position toward the open position.

* * * * *